US008863409B2

(12) United States Patent
Farina et al.

(10) Patent No.: US 8,863,409 B2
(45) Date of Patent: Oct. 21, 2014

(54) SHOE HAVING AN AIR CUSHIONING BED

(75) Inventors: Salvo Farina, Flushing, NY (US); Steve Weston, New Canaan, CT (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 810 days.

(21) Appl. No.: 12/579,913

(22) Filed: Oct. 15, 2009

(65) Prior Publication Data

US 2011/0088281 A1 Apr. 21, 2011

(51) Int. Cl.
*A43B 13/20* (2006.01)
*A43B 13/12* (2006.01)

(52) U.S. Cl.
CPC ..... *A43B 13/20* (2013.01); *A43B 13/12* (2013.01)
USPC ..... 36/29; 36/35 B; 36/30 R

(58) Field of Classification Search
USPC ..... 36/29, 153, 154, 35 B, 93, 88
See application file for complete search history.

(56) References Cited

U.S. PATENT DOCUMENTS 2,600,239 A * 6/1952 Gilbert ..... 36/153
3,990,457 A * 11/1976 Voorhees ..... 36/153
4,017,931 A * 4/1977 Golden ..... 12/146 B
4,115,934 A * 9/1978 Hall ..... 36/44
4,123,855 A * 11/1978 Thedford ..... 36/44
5,199,191 A * 4/1993 Moumdjian ..... 36/28
5,406,719 A * 4/1995 Potter ..... 36/28
5,595,004 A * 1/1997 Lyden et al. ..... 36/29
5,686,167 A * 11/1997 Rudy ..... 428/178
5,718,063 A * 2/1998 Yamashita et al. ..... 36/28
5,784,807 A * 7/1998 Pagel ..... 36/93
5,832,630 A * 11/1998 Potter ..... 36/29
5,846,063 A * 12/1998 Lakic ..... 417/440
6,009,637 A * 1/2000 Pavone ..... 36/29
6,192,606 B1 * 2/2001 Pavone ..... 36/29
7,395,615 B2 7/2008 Lee
7,451,555 B1 * 11/2008 Lakic ..... 36/29
7,950,169 B2 * 5/2011 Holt et al. ..... 36/29
8,307,569 B2 * 11/2012 McInnis et al. ..... 36/28
2004/0255487 A1 * 12/2004 Stubblefield et al. ..... 36/29
2005/0005473 A1 1/2005 Oh
2006/0277801 A1 * 12/2006 Schwarze et al. ..... 36/141
2007/0294916 A1 12/2007 Park

* cited by examiner

*Primary Examiner* — Jila M Mohandesi
(74) *Attorney, Agent, or Firm* — McAndrews, Held & Malloy, Ltd.

(57) ABSTRACT

An air cushioning system for use in a shoe is formed from a first layer of a plastic material and a second layer of plastic material both of which are sized to fit within an interior of the shoe. The periphery of the second layer is joined to the periphery of the first layer and one or more interior locations within the periphery of the second layer are also joined to correspondingly adjacent interior locations within the periphery of the first layer. The unjoined surfaces of the second layer are spaced from the first layer and thereby function to define a trapped air chamber within the joined peripheries of the second layer and the first layer.

21 Claims, 3 Drawing Sheets

SHOE HAVING AN AIR CUSHIONING BED

BACKGROUND

In the art, air cushioning systems for shoes are generally known. For example, U.S. Pat. No. 7,395,615 discloses a pumping device for use in a shoe that includes a cushion body formed inside a sole of the shoe. The cushion body includes front and back air chambers disposed in the front and heel of the shoe, respectively. A pump is mounted adjacent to and in communication with the back air chamber and a suction valve and a check valve are mounted at the front and back sides of the pump to provide air to the back air chamber. A pressure adjusting valve provides a connection between the back air chamber and the front air chamber.

A further example of an air cushioning system is disclosed in U.S. Published Application No. 2005/0005473 which describes a shoe insert that functions to form a pumping chamber. Connected to the pumping chamber is an air inlet conduit as well as an air outlet check valve that leads to an air outlet conduit. When the pumping chamber is in a pumping mode during use, air is brought into the shoe from the outside via the air inlet conduit and circulated through the midsole and toe region of the shoe via the air outlet conduit.

Yet further, U.S. Publication No. 2007/0294916 discloses an air cushioning and circulation system for a shoe. The shoe is provided with first and second air rooms that are formed in the front and rear of the shoe, respectively. The first and second air rooms communicate with each other through passages. A plurality of sucking holes are formed in the inner sole layer to communicate air to throughholes provided to the first air room. First and second buffering members are incorporated in the first and second air rooms, respectively, to alleviate shock and circulate the air. In addition, a first check valve is disposed in the front of the second air room to open and close the passages and a second check valve is disposed in the rear of the second air room to communicate with the outside so as to discharge the air.

Still further, commonly assigned U.S. application Ser. No. 12/360,879, filed on Jan. 28, 2009, discloses an air cushioning system that includes a molded heel absorber member the includes a center member that forms a sealed center air chamber and a peripheral member that extends about at least a portion of the periphery of the center member and that forms a vented peripheral air chamber. A vented air conduit is in communication with the vented peripheral air chamber.

Each of these publications is incorporated herein by reference in its entirety.

SUMMARY

A novel air cushioning bed for a shoe is hereinafter described. Generally, the air cushioning bed includes a first layer of a plastic material and a second layer of plastic material both of which are sized to fit within an interior of the shoe. The periphery of the second layer is joined to the periphery of the first layer and one or more interior locations within the periphery of the second layer are also joined to correspondingly adjacent interior locations within the periphery of the first layer. The unjoined surfaces of the second layer are spaced from the first layer and thereby define a trapped air chamber within the joined peripheries of the second layer and the first layer.

The constructed air cushioning bed is preferably attached to a shoe upper, for example by means of being strobel stitched thereto, with the shoe upper and air cushioning bed then being attached to a shoe outsole to thereby provide the finished shoe product.

A better understanding of the objects, advantages, features, properties and relationships of the novel air cushioning system will be obtained from the following detailed description and accompanying drawings which set forth an illustrative, preferred embodiment indicative of the various ways in which the principles of the invention may be employed.

BRIEF DESCRIPTION OF THE DRAWINGS

For a better understanding of the shoe having an air cushioning bed described hereinafter reference may be had to the following drawings in which.

DETAILED DESCRIPTION

Figure 1:
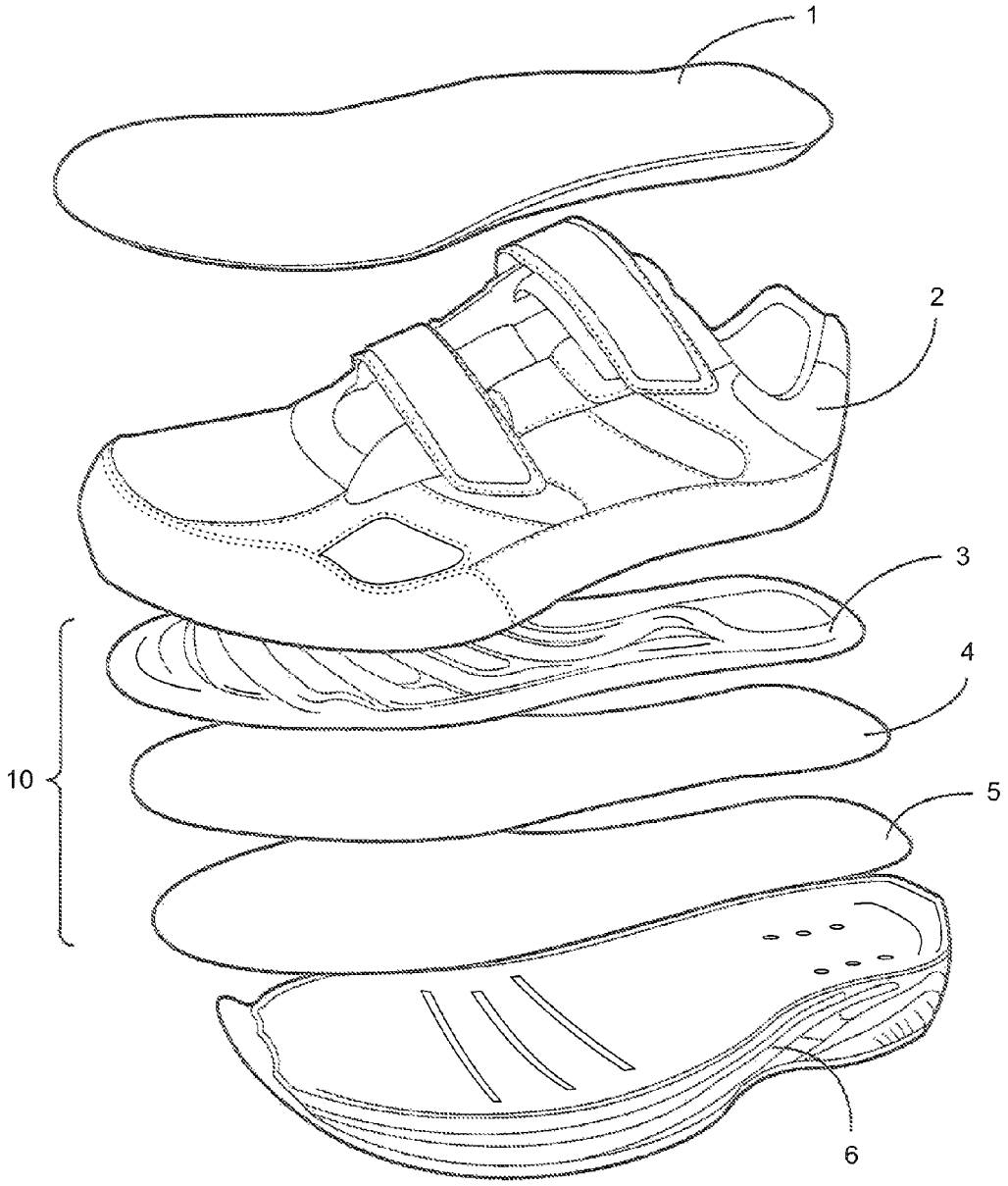
FIG. 1 is an exploded view of a shoe showing an exemplary air cushioning bed constructed in accordance with the invention claimed.

Referring now to the figures, a novel air cushioning bed 10 for use in connection with a shoe which includes an outsole 6, a shoe upper 2, and a shoe foot bed 1 is generally described. As particularly illustrated in FIG. 1, the air cushioning bed 10 is comprised of a base layer 5, an intermediate layer 4, and an upper layer 3. When the shoe is constructed, the air cushioning bed 10 is positioned over the outsole 6, the shoe foot bed 1 is positioned over the air cushioning bed 10, and the shoe upper 2 is stitched to the shoe components in a conventional manner. More particularly, the constructed air cushioning bed 10 is preferably attached to the shoe upper 2, for example by means of being strobel stitched thereto, with the shoe upper 2 and air cushioning bed 10 then being attached to the shoe outsole to thereby provide the constructed shoe product.

Considering now the air cushioning bed 10 in greater detail, the upper layer 3 and base layer 5 are preferably constructed from a plastic material such as a thermal polyurethane material of approximately 0.3 mm in thickness or the like. While the base layer 5 is generally planar, the upper layer 3 is constructed or pre-molded so as to have a generally planar periphery surface and a bubbled or contoured interior surface which includes areas that are co-planar with the periphery. Meanwhile, the intermediate layer 4 is preferably constructed from a nylon textile material or the like. The intermediate layer 4, the upper layer 3, and the base layer 5 have the same general length and width dimensions.

To form the air cushioning bed 10, the intermediate layer 4 is positioned between the base layer 5 and the upper layer 3 and the base layer 5 and the upper layer 3 are heat welded to each other. In this manner, the planar surfaces of the upper layer 3, i.e., the periphery of the upper layer 3 and the interior surfaces generally co-planar with the periphery of the upper layer 3, bond to the correspondingly adjacent surfaces of the base layer 5 through the nylon material of the intermediate layer 4. The locations 20 where the co-planar surfaces of the upper layer 3 are bonded with the correspondingly adjacent planar surfaces of the base layer 5 also functions to create an air chamber 22 between the bubbled or contoured surfaces of the upper layer 3 and the planar surface of the lower layer 5, i.e., air is trapped in the locations where the surface of the upper layer 3 is spaced from the base layer 5. When formed, the air chamber 22 has an outer boundary that is defined, in the illustrated example, by the bonded planar surfaces that are located at the periphery 20*a* of the air cushion bed 10.

Figure 2:
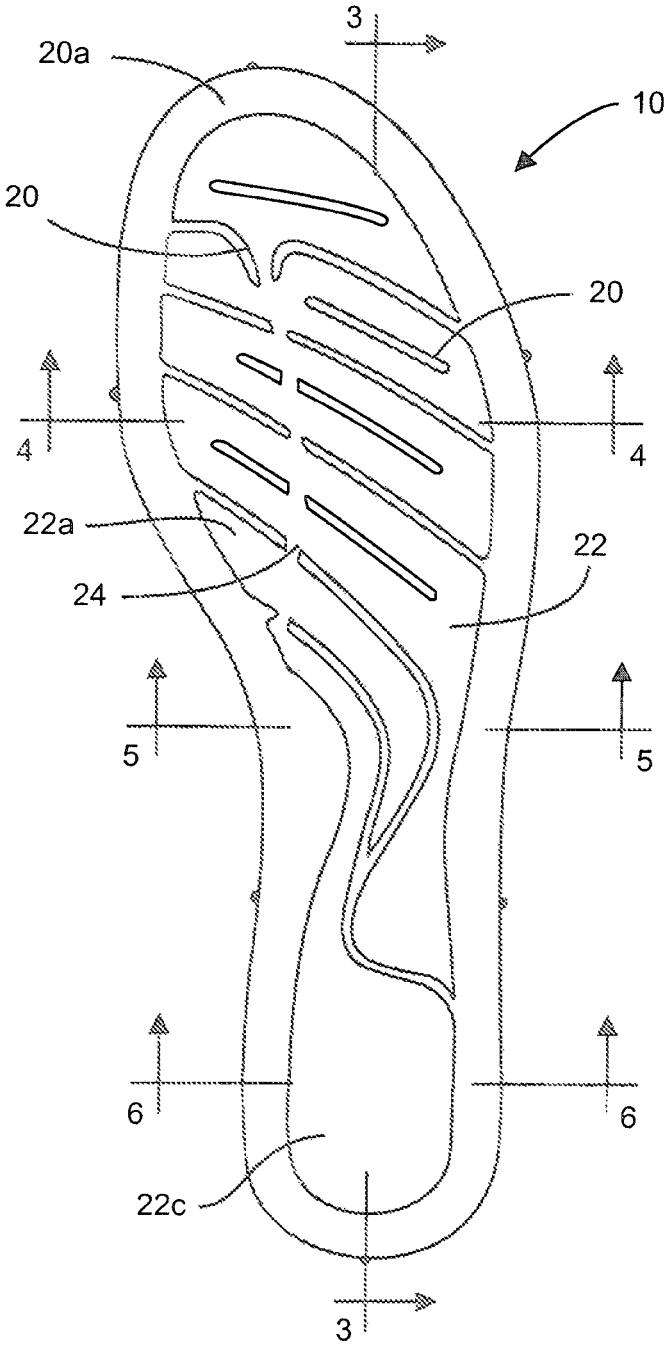
FIG. 2 is a top view of the exemplary air cushioning bed of FIG. 1.
Figure 3:
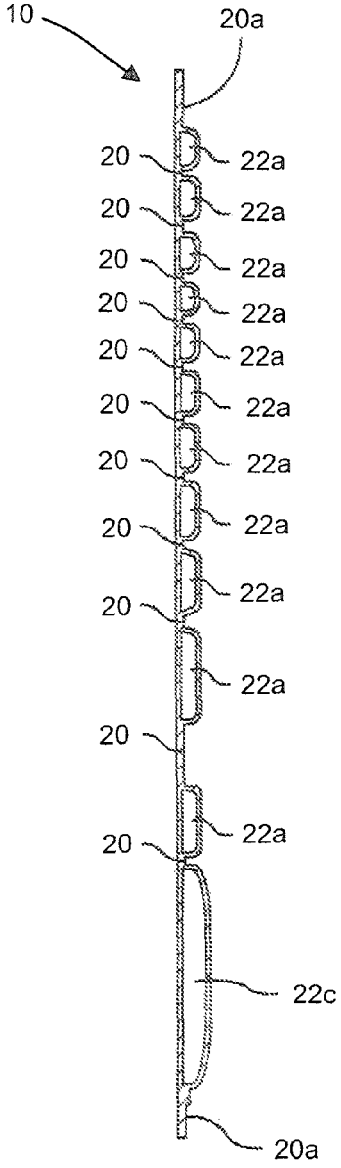
FIG. 3 is a cross-sectional view of the exemplary air cushioning bed of FIG. 2 along line A-A thereof.

Considering FIGS. 2-6, an exemplary pattern for the air chamber 22 is illustrated. It is to be understood that this pattern is not intended to be limiting and that other air chamber patterns may be utilized. In the illustrated, exemplary embodiment of the air cushion bed 10, it is seen that the air chamber 22 defined within the outer bonded periphery 20*a* of the air cushion bed 10 is comprised of plural air chamber sub-pockets 22*a* which are in fluid communication with one another. As seen in FIG. 2, the air chamber sub-pockets 22*a* are substantially, but not entirely, bounded by the co-planar areas of the upper layer 3 that are bonded with the correspondingly adjacent areas of the bottom layer 5, i.e., there are spaces 24 so as to provide interconnectivity between adjacent sub-pockets 22*a*. While illustrated as having a single air chamber 22 comprised of plural sub-pockets 22*a* that are in fluid communication with one another, the air chamber 22 can include plural, discrete air pockets without limitation.

Figure 4:
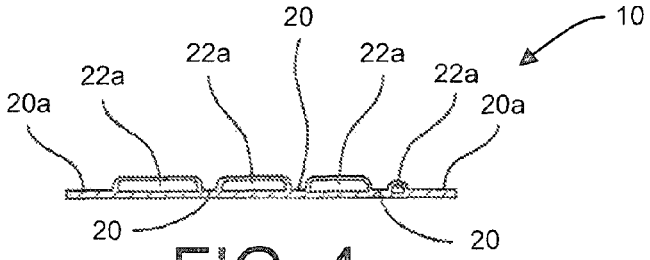
FIG. 4 is a cross-sectional view of the exemplary air cushioning bed of FIG. 2 along line B-B thereof.
Figure 5:
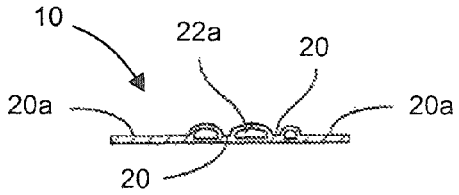
FIG. 5 is a cross-sectional view of the exemplary air cushioning bed of FIG. 2 along line C-C thereof.
Figure 6:
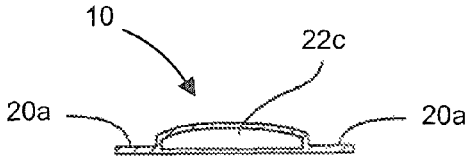
FIG. 6 is a cross-sectional view of the exemplary air cushioning bed of FIG. 2 along line D-D thereof.

The height of the sub-pockets 22*a*, i.e., the distance between the top surface of the upper layer 3 and the lower surface of bottom layer 5, need not be uniform over the entirety of the air cushioning bed 10. For example, as seen in FIG. 4, the height of the sub-pocket 22*c* located in the heel portion of the shoe, which itself may be provided with the largest sub-pocket surface area, can be greater than the height provided to the remaining sub-pockets. The height of the sub-pockets may thus range, without limitation, from approximately 7 mm at the heel to approximately 4 mm towards the middle and/or toe portions of the air cushioning bed 10.

While specific examples of an air cushioning bed have been described in detail, it will be appreciated by those skilled in the art that various modifications and alternatives to those details could be developed in light of the overall teachings of this disclosure. By way of example only, the cross-sections as illustrated in FIGS. 4-7 may be provided with any suitable shape. Accordingly, the particular arrangements disclosed are meant to be illustrative only and not limiting as to the scope of the invention which is to be given the full breadth of the appended claims and any equivalents thereof.

What is claimed is:

1. An air cushioning bed for use in a shoe, comprising:
a first layer of a planar plastic material; and
a second, generally contoured layer of plastic material,
wherein the first and second layers are sized to fit within an interior of the shoe, a periphery of the second layer is joined to a periphery of the first layer, one or more interior locations within the periphery of the second layer which are generally co-planar with the periphery of the second layer are joined to correspondingly adjacent locations within the periphery of the first layer, and unjoined contoured surfaces of the second layer that are spaced from the first layer function to define a trapped air chamber within the joined peripheries of the second layer and the first layer, while the first layer remains at least substantially planar after the trapped air chamber is defined, the trapped air chamber is defined without introducing air from a separate air source, and wherein the trapped air chamber comprises a plurality of air chamber sub-pockets that are fluidly interconnected with each other from a heel to a toe of the shoe, wherein an air chamber sub-pocket in the heel of the shoe provides a largest sub-pocket surface area of the fluidly interconnected air chamber sub-pockets.

2. The air cushioning bed as recited in claim 1, wherein the second layer comprises pre-molded plastic material, wherein the contoured surfaces are formed prior to the first layer being joined to the second layer.

3. The air cushioning bed as recited in claim 1, wherein the trapped air chamber comprises a plurality of discrete air chamber pockets.

4. The air cushioning bed as recited in claim 2, wherein a one of the plurality of air chamber sub-pockets is located in a location corresponding to a heel of the shoe.

5. The air cushioning bed as recited in claim 3, wherein the one of the plurality of air chamber sub-pockets located in a location corresponding to the heel of the shoe has a height greater than a height provided to remaining ones of the plurality of air chamber sub-pockets.

6. The air cushioning bed as recited in claim 1, wherein the plurality of air chamber sub-pockets have heights that range from approximately 4 mm to approximately 7 mm.

7. The air cushioning bed as recited in claim 2, wherein at least a portion of the plurality of air chamber sub-pockets extend generally laterally with respect to a toe to heel axis of the shoe.

8. The air cushioning bed as recited in claim 1, wherein the at least a portion of the plurality of air chamber sub-pockets are in fluid communication via passages which are generally aligned parallel to the toe to heel axis of the shoe, wherein at least some of the passages serially connect the air chamber sub-pocket in the heel to an air chamber sub-pocket in the toe via other fluidly communicating air chamber sub-pockets therebetween.

9. The air cushioning bed as recited in claim 1, wherein the first layer and the second layer are joined by a heat sealing process.

10. The air cushioning bed as recited in claim 9, comprising a layer of nylon material disposed between the first layer and the second layer, wherein during the heat sealing process, the one or more interior locations within the periphery of the second layer, which are generally co-planar with the periphery of the second layer, are joined to the correspondingly adjacent locations within the periphery of the first layer through the layer of nylon material.

11. A shoe, comprising:
an outsole;
an upper attached to the outsole; and
an air cushioning bed disposed adjacent an upper, interior surface of the outsole,
wherein the air cushioning bed is strobe stitched to the upper, the air cushioning bed comprising:
a first layer of a planar plastic material; and
a second, generally contoured layer of plastic material,
wherein the first layer and the second layer comprise thermal polyurethane material of approximately 0.3 mm thickness,
wherein the first and second layers are sized to fit within an interior of the shoe, a periphery of the second layer is joined to a periphery of the first layer, one or more interior locations within the periphery of the second layer which are generally co-planar with the periphery of the second layer are joined to correspondingly adjacent locations within the periphery of the first layer, and unjoined contoured surfaces of the second layer that are spaced from the first layer function to define a trapped air chamber within the joined peripheries of the second layer and the first layer, while the first layer remains at least substantially planar after the trapped air chamber is defined, the trapped air chamber is defined without introducing air from a separate air source, and wherein the trapped air chamber comprises a plurality of air chamber sub-pockets that are fluidly interconnected with each other from a heel to a toe of the shoe, wherein an air chamber sub-pocket in the heel of the shoe provides a largest sub-pocket surface area of the fluidly interconnected air chamber sub-pockets.

12. The shoe as recited in claim 11, wherein the second layer, but not the first layer, has a bubbled interior surface.

13. The shoe as recited in claim 11, wherein the second layer comprises pre-molded plastic material, wherein the contoured surfaces are formed prior to the first layer being joined to the second layer.

14. The shoe as recited in claim 11, wherein the trapped air chamber comprises a plurality of discrete air chamber pockets.

15. The shoe as recited in claim 13, wherein a one of the plurality of air chamber sub-pockets is located in a location corresponding to a heel of the shoe.

16. The shoe as recited in claim 14, wherein the one of the plurality of air chamber sub-pockets located in a location corresponding to the heel of the shoe has a height greater than a height provided to remaining ones of the plurality of air chamber sub-pockets.

17. The shoe as recited in claim 16, wherein the one of the plurality of air chamber sub-pockets have heights that range from approximately 4 mm to approximately 7 mm.

18. The shoe as recited in claim 13, wherein at least a portion of the plurality of air chamber sub-pockets extend generally laterally with respect to a toe to heel axis of the shoe.

19. The shoe as recited in claim 11, wherein the at least a portion of the plurality of air chamber sub-pockets are in fluid communication via passages which are generally aligned parallel to the toe to heel axis of the shoe, wherein at least some of the passages fluidly connect the air chamber sub-pocket in the heel to an air chamber sub-pocket in the toe via other fluidly communicating air chamber sub-pockets therebetween.

20. The shoe as recited in claim 11, wherein the first layer and the second layer are joined by a heat sealing process.

21. The shoe as recited in claim 20, comprising a layer of nylon material disposed between the first layer and the second layer, wherein during the heat sealing process, the one or more interior locations within the periphery of the second layer, which are generally co-planar with the periphery of the second layer, are joined to the correspondingly adjacent locations within the periphery of the first layer through the layer of nylon material.

* * * * *